US007182652B2

(12) United States Patent
Yamakado

(10) Patent No.: US 7,182,652 B2
(45) Date of Patent: Feb. 27, 2007

(54) CONNECTOR

(75) Inventor: Toshio Yamakado, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/297,953

(22) Filed: Dec. 8, 2005

(65) Prior Publication Data

US 2006/0141872 A1 Jun. 29, 2006

(30) Foreign Application Priority Data

Dec. 28, 2004 (JP) ..... 2004-378430

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 6,296,531 B1 * 10/2001 Nagamine ..... 439/752
6,648,699 B1 * 11/2003 Makino et al. ..... 439/752
6,811,451 B2 * 11/2004 Mase et al. ..... 439/752
6,872,093 B2 * 3/2005 Fukatsu et al. ..... 439/595
6,896,560 B2 * 5/2005 Nakamura et al. ..... 439/752
6,902,443 B2 * 6/2005 Hara et al. ..... 439/752

FOREIGN PATENT DOCUMENTS

JP 6-325814 11/1994

* cited by examiner

*Primary Examiner*—Gary F. Paumen
(74) *Attorney, Agent, or Firm*—Gerald E. Hespos; Anthony J. Casella

(57) ABSTRACT

A retainer (30) has a penetration prevention portion (37) rearward from a locking projection (36) and configured to project into a cavity (22) when the retainer (30) is at a main locking position. A terminal fitting (10) erroneously inserted into a rear portion of the cavity (22) when the retainer (30) is at the main locking position will strike the penetration prevention portion (37) before striking the locking projection (36). Thus the erroneously inserted terminal fitting (10) cannot push the locking projection (36) in a way that could return the retainer (30) to a temporary locking position.

12 Claims, 4 Drawing Sheets

CONNECTOR

BACKGROUND OF THE INVENTION

1. Field of the Invention

The invention relates to a connector.

2. Description of the Related Art

Japanese Patent Application Laid-Open No. 6-325814 discloses a connector with a housing that has opposite front and rear ends and cavities that extend between the ends. The connector also has terminal fittings that can be inserted into the cavities from the rear end of the housing. A retainer can be inserted into a side surface of the housing and can be moved between a temporary locking position and a main locking position. The retainer has locks that are disposed alongside the cavities when the retainer is in the temporary locking position. Thus, the terminal fittings can be inserted into the cavities and removed from the cavities when the retainer is at the temporary locking position. However, the locks penetrate the cavities when the retainer is in the main locking position and hold the terminal fittings in the cavities.

The rear end of the lock of the retainer is tapered to prevent interference with the end of an electric wire caulked to the terminal fitting. However, the steep rear end of the lock may cause the front end of the lock to catch the terminal fitting when the terminal fitting is inserted into the cavity and may cause the terminal fitting to shake. In this case, the terminal fitting cannot be inserted smoothly into the cavity.

Some of the cavities of the housing may intentionally be left vacant. However, an operator may erroneously insert the terminal fitting into a vacant cavity while the retainer is at the main locking position. In this situation, the front end of the terminal fitting will strike the tapered surface at the rear end of the lock of the retainer. A component of force in the retainer insertion direction will be generated on the tapered surface, and the retainer could be pressed back to the temporary locking position.

The invention has been made in view of the above-described situation. Therefore it is an object of the present invention to provide a connector in which a retainer held at a main locking position is prevented from being returned to a temporary locking position by being pressed by a terminal fitting erroneously inserted into a housing.

SUMMARY OF THE INVENTION

The invention relates to a connector with a housing that has a cavity for receiving a terminal fitting. The connector also has a retainer that can be moved between a temporary locking position and a main locking position relative to the housing. The retainer has an engaging portion disposed alongside the cavity when the retainer is in the temporary locking position so that the terminal fitting can be inserted into the cavity and removed therefrom. The engaging portion projects in the cavity and engages the terminal fitting when the retainer is in the main locking position. The retainer has a penetration prevention portion that projects into the cavity and prevents the terminal fitting from penetrating into the cavity when the retainer is at the main locking position. An operator may erroneously try to insert the terminal fitting into the cavity when the retainer is at the main locking position. However, the penetration prevention portion prevents the terminal from advancing into the cavity and hence prevents the retainer from returning to the temporary locking position.

The penetration prevention portion preferably is rearward from the engaging portion in an insertion direction of the terminal fitting. Thus, a terminal fitting that is inserted erroneously into the rear of the cavity strikes the penetration prevention portion before the terminal fitting strikes the engaging portion, and the terminal is prevented from advancing into the cavity. Therefore, the front end of the terminal fitting will not strike the engaging portion and the retainer is prevented from returning to the temporary locking position. Further, the operator can identify an erroneous attempt to insert the terminal fitting into the cavity shortly after the front end of the terminal fitting reaches the retainer.

DETAILED DESCRIPTION OF THE PREFERRED EMBODIMENTS

Figure 1:
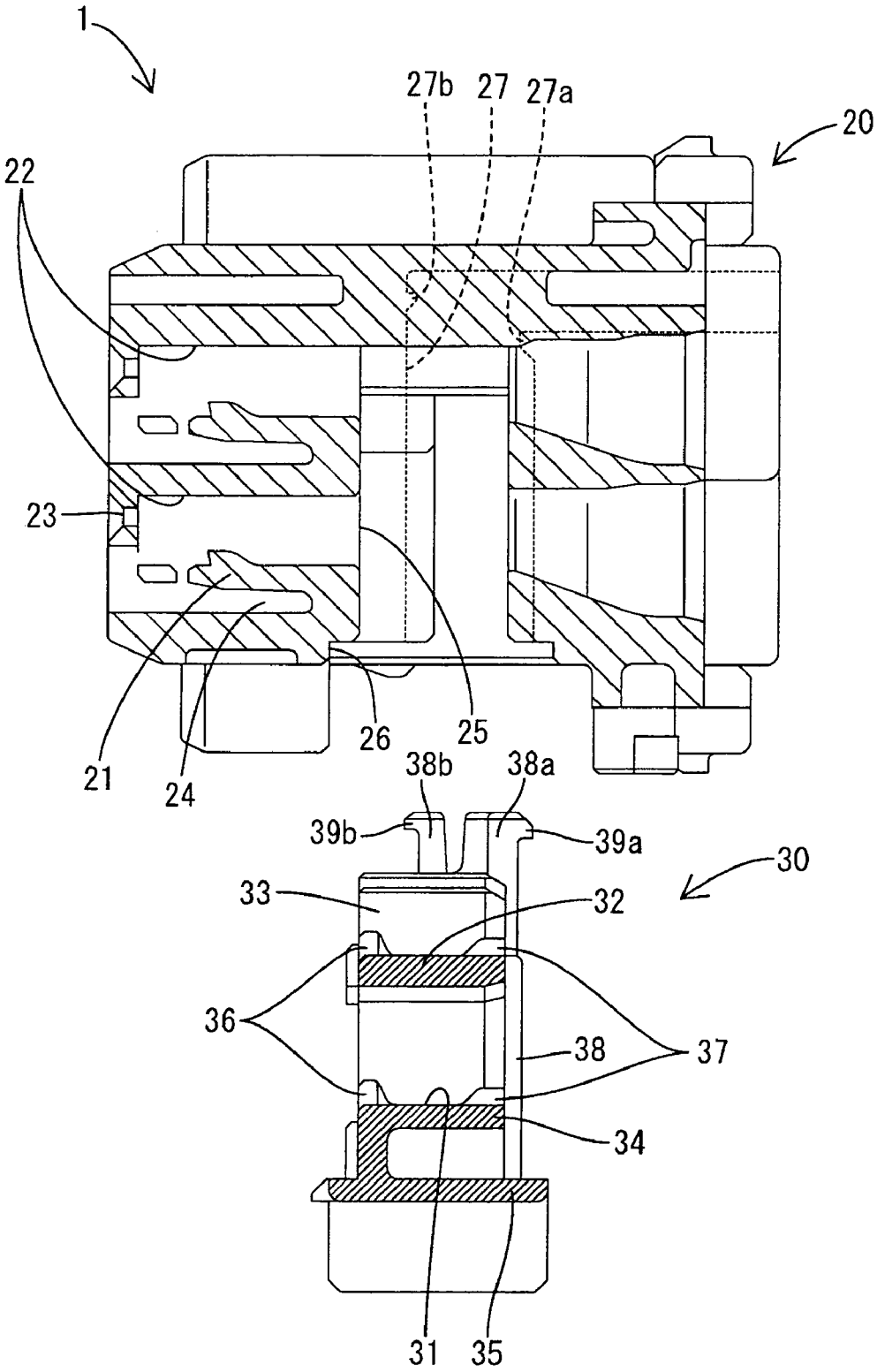
FIG. 1 is a vertical sectional view showing a state before a retainer of an embodiment of the present invention is mounted in a housing.
Figure 2:
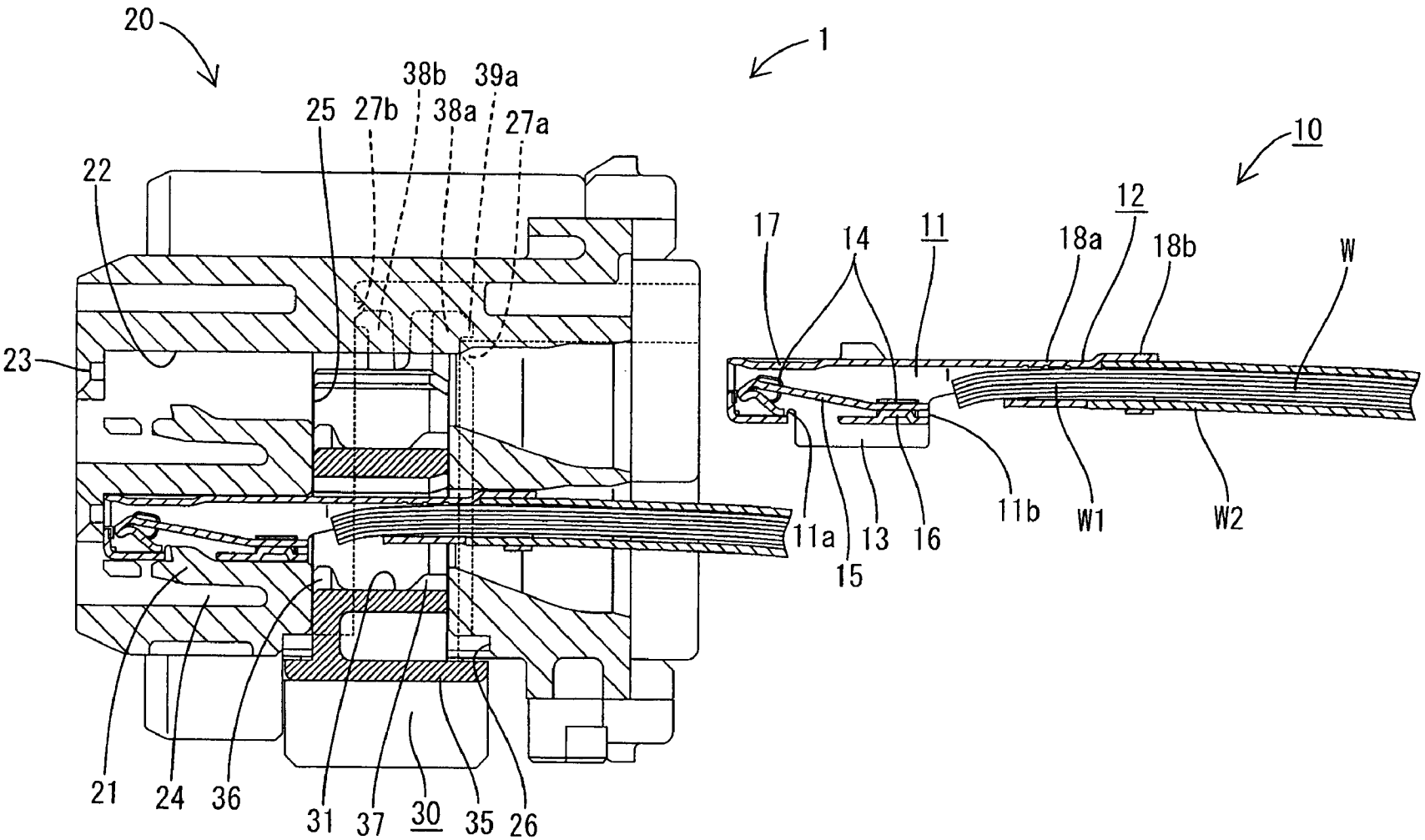
FIG. 2 is a vertical sectional view showing a state in which the retainer is held at a temporary locking position.
Figure 3:
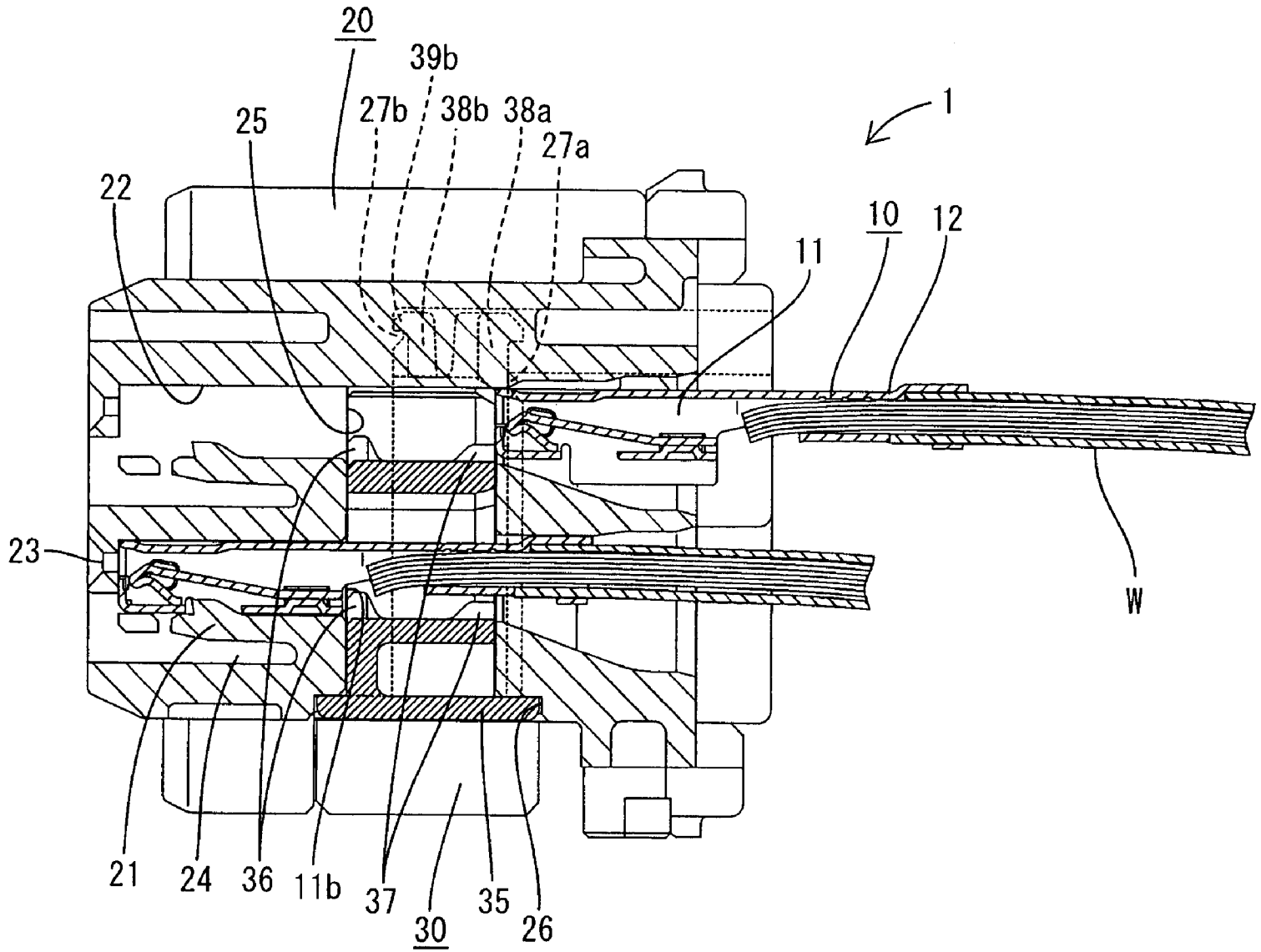
FIG. 3 is a vertical sectional view showing a state in which the retainer is held at a main locking position.
Figure 4:
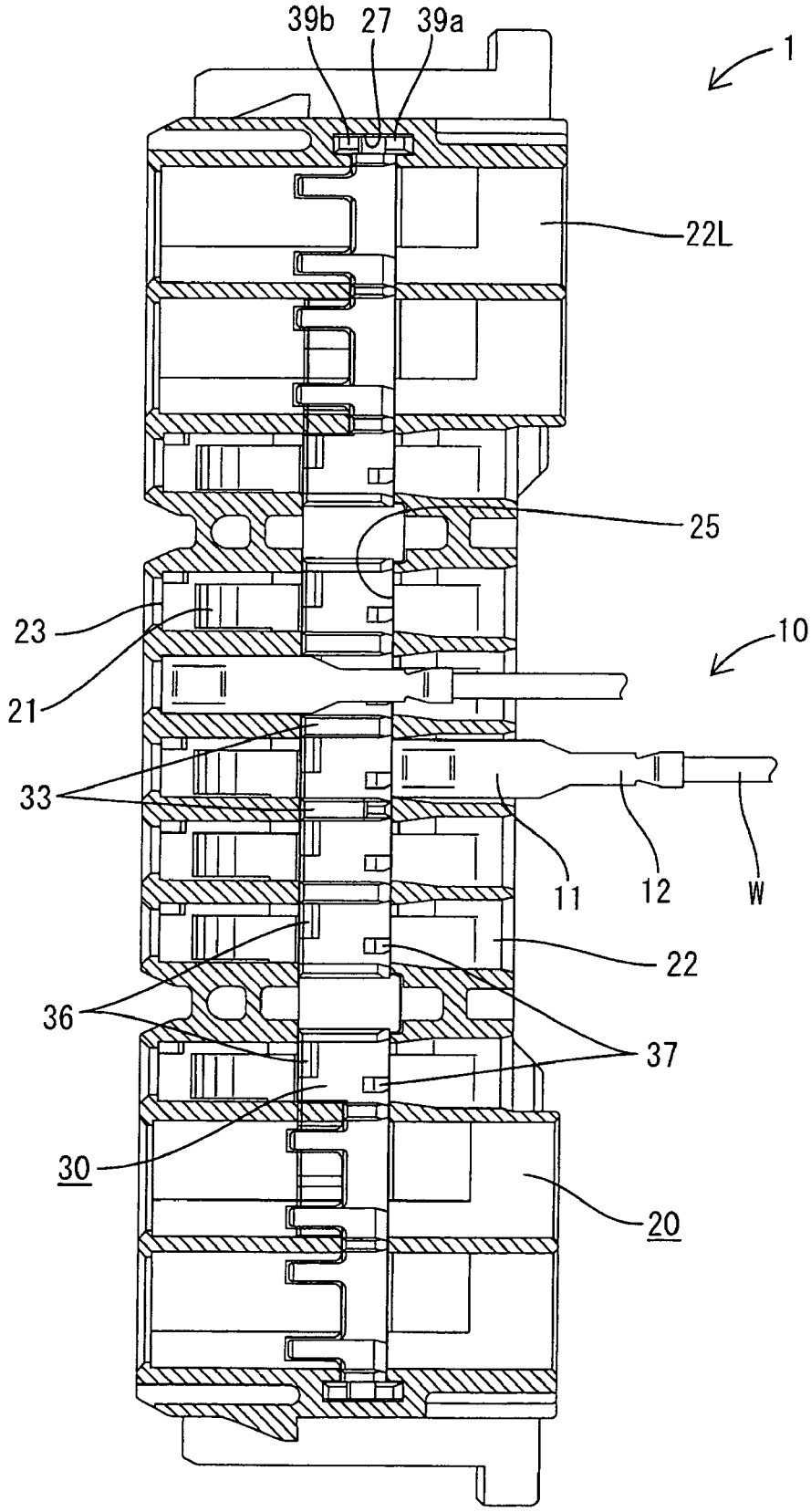
FIG. 4 is a plan sectional view showing the state in which the retainer is held at the temporary locking position.

A connector according to the invention is identified by the numeral 1 in FIGS. 1 through 4. The connector 1 has large and small terminal fittings 10 accommodated in a housing 20, and hence is referred to as a hybrid connector. The connector 1 also has a retainer 30 for holding the terminal fittings 10 in the housing 20. The direction in which the terminal fitting 10 is inserted into the housing 20 is referred to herein as the front. The upper side in FIG. 2 is referred to herein as the top, and the lower side in FIG. 2 is referred to as the bottom. The terms top and bottom are used as a convenient frame of reference and do not imply a required gravitational orientation The upper side in FIG. 4 is referred to as the left side and the lower side in FIG. 4 is referred to as the right side.

The small terminal fitting 10 is formed by punching a metal plate into a predetermined configuration and bending the metal plate. The small terminal fitting 10 is longitudinally long and narrow and has opposite front and rear ends. An approximately square tubular body 11 is disposed at the front end of the small terminal fitting 10 and is configured to receive a tab (not shown) of a mating terminal fitting. A barrel 12 is disposed at the rear end of the small terminal fitting 10 and is configured for crimped connection with an electric wire W is crimped (see FIG. 2).

A primary lock 11*a* is formed on a lower surface of the body 11 and is a hole configured for locked connection with a lance 21 in the housing 20. A second lock 11*b* is formed at the rear of the body 11. A lower end of one side wall 13 of the body 11 rearward from the primary lock 11*a* extends down from a bottom wall of the body 11. An approximately central portion of an upper end of the one side wall 13 of the body 11 rearward from the primary lock 11*a* projects up in an approximately trapezoidal shape. A front side of the trapezoid is approximately vertical to the upper end surface of the portion of one side wall 13 rearward from the primary locking hole 11*a*. Engaging holes 14 are formed on the side wall 13 at front and rear positions thereof. The above-described upward and downward projected portions of the side wall 13 penetrate into a guide groove (not shown in the drawings) inside a cavity 22 upon insertion of the terminal fitting 10 into the cavity 22.

An elastic contact 15 is formed inside the body 11 and is elastically deformable in a vertical direction. The elastic contact 15 is in the shape of a mountain, and a front longitudinal portion of the elastic contact 15 is at the apex of the mountain. A receiving portion 16 bulges in from the bottom wall of the body 11 and engages the elastic contact 15 when the elastic contact 15 is displaced down. A tab (not shown) of a mating terminal fitting can penetrate into the body 11 from the front of the terminal fitting 10. Thus, the tab of the mating terminal fitting is sandwiched under pressure between the elastic contact 15 and a bulge 17 that projects down from an upper wall of the body 11. The elastic contact 15 has a projection inserted into the engaging hole 14 on the side wall 13. Excessive deformation of the elastic contact piece 15 is prevented by the projection and the engaging hole 14.

The barrel 12 has a front caulking piece 18*a* that is crimped to a core wire W1 exposed at the end of an electric wire W and a rear caulking piece 18*b* that is crimped to a coating W2 of the electric wire W to connect the electric wire W to the terminal fitting 10.

The housing 20 is made of synthetic resin and has an approximately oblong shape (see FIG. 4). Cavities 22 are formed in upper and lower stages in the housing 20 and extend longitudinally into the housing 30 for accommodating the terminal fittings 20. Cavities 22L are formed at both lateral sides of the cavities 22 for accommodating the large terminal fittings. The terminal fittings 10 can be inserted into the cavities 22 from the rear of the housing 20. Tab insertion openings 23 are formed in a front wall of the housing 20 at positions corresponding to the respective cavities 22 and can receive the tabs of the respective mating terminal fittings. An approximately cone-shaped guide surface is formed entirely on a front peripheral edge of the tab insertion opening 23 to ensure smooth insertion of the mating terminal fitting into the tab insertion opening 23. A lance 21 is cantilevered forward from the bottom surface of each cavity 22 for locking to the primary lock 11*a* of the terminal fitting 10. A flexible space 24 is formed below the lance 21 and is open toward its front side. The lance 21 is elastically deformable towards the flexible space 24.

As shown in FIG. 1, an oblong retainer insertion opening 25 is formed at a central longitudinal position of the bottom wall of the housing 20 and rearward the lance 21. The retainer insertion opening 25 extends up into the bottom surface of the housing 20 and penetrates through the cavities 22. A retainer insertion opening edge 26 is formed at the lower end of the retainer insertion opening 25 and flares outwardly to wider dimensions.

A groove-shaped side plate insertion portion 27 opens down at left and right ends of an upper surface of the retainer insertion opening 25. A temporary locking projection 27*a* projects forward from a rear edge of each side plate insertion portion 27 and a main locking projection 27*b* projects rearward from a front edge of each side plate insertion portion 27 at a position slightly up from the temporary locking projection 27*a*. Lower ends of the temporary locking projection 27*a* and the main locking projection 27*b* are formed as guide slopes that incline up into the retainer insertion opening 25. Upper ends of the temporary locking projection 27*a* and the main locking projection 27*b* are formed as locking surfaces aligned substantially orthogonal to the direction in which the retainer insertion direction.

The connector also includes a retainer 30 formed from a synthetic resin. The retainer 30 can be inserted into the retainer insertion opening 25 of the housing 20 from below. The retainer 30 is long and narrow in a width direction and can be inserted tightly into the retainer insertion opening 25. Through-holes 31 penetrate through the retainer 30 and communicate with the respective lower-layer cavities 22 of the housing 20 when the retainer 30 is mounted in the housing 20. An upper plate 32 is formed as a ceiling of the through-hole 31 and a space above the upper plate 32 corresponds to the upper-layer cavities 22 of the housing 20. Partitioning walls 33 extend up from an upper surface of the upper plate 32 and align with partitioning walls between the cavities 22 (see FIG. 4). A lower plate 34 defines a bottom surface of each through-hole 31 and a substrate 35 is provided below the lower plate 34. The substrate 35 is slightly larger than the lower plate 34 and can be fit in the retainer insertion opening edge 26.

Upper surfaces of the upper and lower plates 32 and 34 become flush with the bottom surfaces of the respective upper and lower stage cavities 22 and 22. Additionally, locking projections 36 and penetration prevention portions 37 are formed on the upper surfaces of the upper and lower plates 32 and 34 at locations corresponding to the respective cavities 22.

The locking projections 36 are formed at a front end of the upper surface of the lower plate 34 and at a front end of the upper surface of the upper plate 32. The locking projections 36 are disposed at a left-hand side between adjacent partitioning walls of the upper surface of the lower plate 34 and between adjacent partitioning walls of the upper surface of the upper plate 32. Each locking projection 36 has a width about half the distance between the adjacent partitioning walls of the upper surface of each of the upper and lower plates 32 and 34. A rear portion of each locking projection 36 slopes up and forward from the upper surface of each of the upper and lower plates 32 and 34. Thus, the end of the electric wire W caulked to the terminal fitting 10 does not interfere with the locking projection 36. Further even if the terminal fitting 10 is inserted into the cavity 22 with the terminal fitting 10 being shaken, the front end of the terminal fitting 10 is prevented from being caught by the locking projection 36.

The penetration prevention portions 37 are formed rearward from the locking projection 36. Each penetration prevention portion 37 is disposed at a rear end of the retainer 30 and at a right side with respect to the locking projection 36 in the width direction of the retainer 30. A predetermined interval is provided between the right surface of the penetration prevention portion 37 and the partitioning wall 33 that partitions the through-holes 31 opposed thereto. A right rear end of the penetration prevention portion 37 is cut off so that the rear end is narrower than other portions of the penetration prevention portion 37. The rear end surface of the penetration prevention portion 37 is orthogonal to the direction in which the terminal fitting 10 is inserted into the housing 20 and is flush with the rear end surface of the retainer 30. An upper surface of the penetration prevention portion 37 is smooth and planar.

Side plates 38 are formed on the left and right ends of the retainer 30 and are configured to be inserted into the side plate insertion portions 27 at the ends of the retainer insertion opening 25. As shown in FIG. 1, a temporary holding arm 38*a* and a main holding arm 38*b* project up substantially equal distances from each side plate 38. The main holding arm 38*a* is disposed forward from the temporary holding arm 38*a*. Additionally, the temporary holding arm 38*a* and the temporary holding arm 38*b* are disposed back to back and are inwardly elastically deformable. A temporary holding projection 39*a* projects rearward from the upper end the temporary holding arm 38*a* and a main holding projection 39*b* projects forward from the upper end of the main holding arm 38*b*. The upper surfaces of the temporary holding projection 39*a* and the main holding projection 39*b* slope with respect to the insertion direction of the retainer 30 into the retainer insertion opening 25. The lower surfaces of the temporary holding projection 39*a* and the main holding projection 39*b* are aligned substantially orthogonal to the direction in which the retainer 30 is inserted into the retainer insertion opening 25. The vertical length of the main holding projection 39*b* is smaller than the vertical length of the temporary holding projection 39*a*. Thus, the locking surface of the main holding projection 39*b* is disposed above the locking surface of the temporary holding projection 39*a*.

The retainer 30 initially is mounted in the housing 20 in a temporary locked state. However, the retainer 30 can be pressed into the retainer insertion opening 25 from the lower side of the housing 20. As a result, the temporary holding arm 38*a* rides over sloped lower guide surface of the temporary locking projection 27*a* and flexes elastically forward. The temporary holding arm 38*a* returns elastically to its original state as soon as the temporary holding projection 39*a* rides across the temporary locking projection 27*a*. Thus, the lower locking surface of the temporary holding projection 39*a* is locked to the locking surface of the upper surface of the temporary locking projection 27*a* and the retainer 30 is held at the temporary locking position. At this time, the guide slope of the main holding projection 39*b* of the main holding arm 38*b* contacts the guide slope of the main locking projection 27*b* from below.

The terminal fittings 10 are inserted into the cavities 22 of the housing 20 while the retainer 30 is at the temporary locking position. At this time, the locking projections 36 and the penetration preventions 37 are below the corresponding cavities 22 so that the terminal fittings 10 can be inserted into the cavities 22. Thus, the terminal fitting 10 can pass above the locking projection 36 and the penetration prevention 37 during insertion into the cavities 22. The terminal fitting 10 is pressed further into the cavity 22 and deforms the lance 21 elastically down. The lance 21 returns elastically to its original state when the terminal fitting 10 is pressed to a predetermined normal position. Thus, the lance 21 fits in the primary locking portion 11*a* on the lower surface of the terminal fitting 10 to lock the terminal fitting 10 thereto.

The retainer 30 is pressed up into the housing 20 from the temporary locking position after all necessary terminal fittings, including the large terminal fittings, are inserted into the respective cavities 22. As a result, the main holding arm 38*b* is guided along the guide slope and rides over the main locking projection 27*b*. Thus, the main holding arm 38 flexes elastically rearward. The main holding arm 38*b* returns elastically to its original state as soon as the main holding projection 39*b* rides across the main locking projection 27*b*. Accordingly, the lower locking surface of the main holding projection 39*b* is locked to the upper locking surface of the main locking projection 27*b*, and the substrate 35 of the retainer 30 is fit in the retainer insertion opening edge 26 of the housing 20. Therefore, the retainer 30 is held at a main locking position. At this time, the lower surface of the substrate 35 is almost flush with the lower surface of the housing 20. In this manner, with the retainer 30 held at the main locking position, the locking projection 36 and the penetration prevention 37 penetrate into the cavity 22, and the front surface of the locking projection 36 contacts the second locking portion 11*b* of the corresponding terminal fitting 10, thus secondarily locking the terminal fitting 10.

The terminal fittings 10 are not mounted in all the cavities and some of the cavities 22 are intentionally vacant. In this case, there is a possibility that an operator will erroneously believe that the terminal fitting 10 has been inadvertently omitted from the vacant cavity 22 and will attempt to insert a terminal fitting 10 into the vacant cavity 22. The front end of the terminal fitting 10 erroneously pressed into the rear portion of the cavity 22 could strike the tapered surface of the locking projection 36 of the retainer 30, and there is a fear that a downward component of this force on the tapered surface will press the retainer 30 back to the temporary locking position.

However, the front end of the terminal fitting 10 that is inserted erroneously into the rear portion of the cavity 22 reaches the retainer insertion opening 25 and strikes the rear end surface of the penetration prevention portion 37 of the retainer 30 to prevent further penetration into the cavity 22. Thus, the front end of the terminal fitting 10 cannot strike the tapered surface of the locking projection 36 of the retainer 30 and the retainer 30 cannot be pressed back to the temporary locking position. The penetration prevention portion 37 is rearward from the locking projection 36. Thus, even though the terminal fitting 10 is inserted erroneously into the rear portion of the cavity 22, the penetration prevention portion 37 stops the insertion before the front end of the terminal fitting 10 strikes the locking projection 36. Thus, the retainer 30 cannot be pressed back to the temporary locking position. Further, the operator can identify an erroneous attempt to insert the terminal fitting 10 into the cavity 22 in a comparatively short period of time. Further, the rear end surface of the penetration prevention portion 37 is orthogonal to the direction in which the terminal fitting 10 is inserted into the cavity 22. Thus, a component of force of pressing the retainer 30 downward is not generated. Accordingly, when the penetration prevention portion 37 is pressed by the terminal fitting 10 erroneously inserted into the cavity 22, the retainer 30 cannot be returned to the temporary locking position.

The penetration prevention portion 37 is at the rear end of the retainer 30. The rear end surface of the penetration prevention portion 37 closely contacts an opposed surface of the retainer insertion opening 25 when the retainer 30 is at the temporary locking position. The front part of the terminal fitting 10 could shake while the terminal fitting 10 is being inserted into the cavity 22. However, there is no gap between the rear end surface of the penetration prevention portion 37 and the opposed surface of the housing 20 that could catch the front end of the terminal fitting 10. A surface of the housing 20 through which the terminal fitting 10 passes is smooth and flat. Thus, the terminal fitting 10 can be inserted smoothly into the cavity 22 when the retainer 30 is held at the temporary locking position without the rear end surface of the terminal fitting 10 being caught even though the rear end surface of the penetration prevention portion 37 is formed steeply to prevent penetration of the terminal fitting 10.

As described above, the retainer 30 has the penetration prevention portion 37 rearward from the locking projection 36 that projects into the cavity 22 when the retainer 30 is held at the main locking position to prevent the terminal fitting 10 from penetrating into the cavity 22. Thus, the terminal fitting 10 that is inserted erroneously into the rear of the cavity 22 when the retainer 30 is at the main locking position strikes the penetration prevention portion 37 before the front end of the terminal fitting 10 strikes the locking projection 36. Thus, the terminal fitting 10 cannot penetrate further into the cavity 22 and the front end of the terminal fitting 10 cannot strike the locking projection 36. Accordingly, the retainer 30 cannot be returned to the temporary locking position. Further, the operator can determine that there has been an erroneous attempt to insert the terminal fitting 10 into the cavity 22 substantially when the front end of the terminal fitting 10 reaches the retainer 30.

The invention is not limited to the above-described embodiment. For example, the following embodiments are included in the technical scope of the present invention. Further, the technical scope of the present invention extends to the range of equivalence.

The penetration prevention portion 37 may have configurations other than the illustrated embodiment provided that the penetration prevention portion 37 is capable of preventing the terminal fitting from being inserted into the cavity 22. For example, the penetration prevention portion 37 may be rod-shaped.

The penetration prevention portion 37 is at the rear end of the upper surface of the lower plate 34 and at the rear end of the upper surface of the upper plate 32 in the illustrated embodiment. However, the penetration prevention portion 37 may be at positions forward from the rear ends of the upper surfaces of the upper and lower plates 32 and 34.

The illustrated embodiment is a non-watertight connector. However, the invention may be applied to a waterproof connector.

The illustrated embodiment is a female connector 1 with a housing 20 that accommodates female terminal fittings 10. However, the invention may be applied to a male connector with a housing that accommodates male terminal fittings.

The illustrated embodiment has terminal fittings 10 primarily locked to the resin lance 21 formed inside the housing 20. However, the terminal fitting 10 may be locked primarily to a metal lance formed by cutting and raising a part of the terminal fitting.

What is claimed is:

1. A connector comprising:

a housing with at least one cavity for receiving at least one terminal fitting; and a retainer insertable into said housing from one side surface of the housing in a direction crossing said cavity, said retainer having an engaging projection capable of engaging said terminal fitting for locking said terminal fitting in the cavity;

said retainer being movable between a temporary locking position where said engaging projection is disposed alongside said cavity and allows said terminal fitting to be inserted into said cavity and removed therefrom and a main locking position where said engaging projection projects in said cavity and engages said terminal fitting; and said retainer having a penetration prevention portion that projects into said cavity and prevents said terminal fitting from penetrating into said cavity when said retainer is held at said main locking position.

2. A connector of claim 1, wherein said penetration prevention portion is provided rearward from said engaging portion in an insertion direction of said terminal fitting.

3. The connector of claim 2, wherein a rear surface of the penetration prevention portion is aligned substantially orthogonal to an insertion direction of the terminal fitting into the cavity.

4. The connector of claim 1, wherein said retainer is configured for movement in a direction substantially orthogonal to an insertion direction of the terminal fitting.

5. The connector of claim 1, wherein the housing has a plurality of cavities.

6. The connector of claim 5, wherein the at least one terminal fitting comprises fewer terminal fittings than cavities.

7. A connector, comprising:

a housing having opposite front and rear ends and a plurality of cavities extending between the ends, a retainer insertion opening extending into a side surface of the housing and intersecting the cavities;

a plurality of terminal fittings disposed respectively in a plurality of the cavities, the terminal fittings being fewer in number than the cavities so that at least one of said cavities has no terminal fitting therein; and a retainer disposed in said retainer insertion opening and being movable between a temporary locking position and a main locking position, the retainer having a plurality of engaging projections corresponding to the respective cavities and a plurality of penetration prevention portions disposed between the engaging projections and the rear end of the housing, the engaging projections and the penetration prevention portions being substantially alongside the respective cavities when the retainer is in the temporary locking position and projecting into the respective cavities when the retainer is in the main locking position.

8. The connector of claim 7, wherein each of said engaging projections has a forwardly facing locking surface aligned to engage one of said terminal fittings when the retainer is in the main locking position for preventing the terminal fitting from being withdrawn from the housing.

9. The connector of claim 8, wherein each of said penetration prevention portions has a rearwardly facing locking surface aligned to prevent one of said terminal fittings from being inserted into the corresponding cavity when the retainer is in the main locking position.

10. The connector of claim 9, wherein the rearwardly facing locking surfaces of the penetration prevention portions are aligned substantially orthogonal to an insertion direction of the terminal fitting into the cavity.

11. The connector of claim 7, wherein said retainer is configured for movement in a direction substantially orthogonal to an insertion direction of the terminal fitting.

12. The connector of claim 7, wherein the penetration prevention portions are substantially adjacent portions of the retainer insertion opening nearest the rear end of the housing.

* * * * *